US006036484A

United States Patent [19]

Carcer et al.

[11] Patent Number: 6,036,484

[45] Date of Patent: Mar. 14, 2000

[54] PROCESS FOR REPROCESSING SLAG AND/OR ASH FROM THE THERMAL TREATMENT OF REFUSE

[75] Inventors: Bruno Carcer, Aarau; Hans Rüegg, Wohlen; Christian Steiner, Zürich; Beat Stoffel, Zumikon, all of Switzerland

[73] Assignee: Asea Brown Boveri AG, Baden, Switzerland

[21] Appl. No.: 09/169,139

[22] Filed: Oct. 9, 1998

[30] Foreign Application Priority Data

Oct. 13, 1997 [EP] European Pat. Off. ..... 97810772

[51] Int. Cl.[7] ..... F27B 15/00

[52] U.S. Cl. ..... 432/105; 432/16; 110/246

[58] Field of Search ..... 432/13, 16, 58, 432/105; 110/243, 246, 235

[56] References Cited

FOREIGN PATENT DOCUMENTS

| | | |
|---|---|---|
| 0372039B1 | 8/1992 | European Pat. Off. . |
| 0722777A1 | 7/1996 | European Pat. Off. . |
| WO93/17280 | 9/1993 | WIPO . |

OTHER PUBLICATIONS

"Drehroohrofen", Esch, et al., pp. 415–431.

"InRec–Verfahren–Verwertung von Reststoffen aus der thermischen Abfallbehandlung", Simon, et al., ABB Technik Sep. 1995, pp. 15–20.

*Primary Examiner*—Tu Ba Hoang
*Assistant Examiner*—Gregory A. Wilson
*Attorney, Agent, or Firm*—Burns, Doane, Swecker & Mathis, L.L.P.

[57] ABSTRACT

In a process for reprocessing slag and/or ash from the thermal treatment of refuse, the refuse (1) is pyrolyzed, gasified or partially combusted in a first process step, heavy-metal-containing slag and/or ash (8) having a comparatively high carbon content being formed. Said slag and/or ash (8) is then heated in a rotary kiln (6) to a temperature below the melting temperature of the slag and/or ash (8) in a second process step, the slag and/or ash (8), prior to its discharge from the rotary kiln (6), dwelling sufficiently long in the rotary kiln (6), that the heavy metals present therein are converted into their metallic form by reduction at the carbon endogenous to the slag and the readily volatile heavy metals are transferred to the gas phase and are discharged from the rotary kiln (6) together with the flue gas (9), and finally a slag (15) depleted in heavy metals being discharged from the rotary kiln (6).

13 Claims, 3 Drawing Sheets

PROCESS FOR REPROCESSING SLAG AND/OR ASH FROM THE THERMAL TREATMENT OF REFUSE

BACKGROUND OF THE INVENTION

1. Field of the invention

The invention relates to the field of thermal waste treatment. It relates to a process for reprocessing slag and/or ash from the thermal treatment of refuse.

2. Discussion of the background

For the thermal treatment of waste/refuse, in addition to the classic waste incineration, many processes are also known in which the refuse is degassed and/or gasified, or combinations of these known processes are employed. The solid reaction products formed in these processes can be further treated in various ways, e.g. thermally, the products which are no longer utilizable then being landfilled. For environmental and cost reasons, attempts are being made to keep these unavoidable amounts of residues as small as possible and to reprocess the slags or ashes so that they can be used again as valuable materials or inert materials.

WO 93/17280, for example, discloses a process for fusing combustion residues in slag, in which the waste is first subjected to low-temperature carbonization in a low-temperature unit and then, with conjoint use of low-temperature carbonization materials and gases, complete combustion with slag liquefaction is carried out in a high-temperature unit at approximately 1200–1400° C. The end product is a completely burnt liquefied slag which can be allowed to solidify in any desired form. Firstly, this slag has a low loss on ignition, i.e. a low content of unburned constituents, secondly, highly toxic hydrocarbon compounds, such as dioxins and furans, are below the detection limits, and heavy metal compounds are said to be incorporated in the slag in virtually insoluble form. These advantages are opposed by the following disadvantages:

1. For domestic refuse incineration, the grate firing process is currently usually used. In this process the refuse is moved mechanically over a horizontal or inclined plane and simultaneously combustion air, which enters the refuse bed from below through the grate, flows through it. The incombustible portion of the waste is discharged from the combustion plant as grate ash or slag. Low-temperature carbonization of the refuse and subsequent slag liquefaction, as in the abovementioned process, is not possible in these widespread existing plants.
2. To fuse the slag in the rotary kiln, very high temperatures are necessary, so that high-grade and expensive brick lining material must be used.
3. In the fusion process, the environmentally harmful heavy metals nevertheless pass in an uncontrolled manner into the environment and cannot be recovered.
4. The high energy consumption, required for the liquefaction, is a further disadvantage.

EP 0 372 039 B1 discloses a process for reprocessing slag from waste incineration plants, in which the slag is discharged dry from the incineration furnace, is subjected to a coarse cleaning (removal of unburned coarse material and magnetic components), and then the coarsely cleaned slag is separated into at least two fractions and all particles which are smaller than 2 mm are assigned to one of these. This process is based on the finding that the fine fraction comprises the majority of the pollutants originally present in the slag. The fine fraction is fed to a special treatment, while the coarse fraction is suitable as building material, for example.

A further development of this process is disclosed in EP 0 722 777 A1. There, a process is claimed for reprocessing slag from refuse incineration plants, in which the crude slag, after passing through the firing grate, is separated directly and without prior quenching in a waterbath into at least two fractions, and these two fractions are further treated separately, the coarse fraction being fed to a wet slag remover. Features of the process are that the first fraction having a particle size less than 80 mm, preferably less than about 32 mm, is separated off in a first screening stage, that the screening oversize is fed to the wet slag removal, that the screen undersize and, if appropriate, the material falling through the firing grate, is fed to a second screening stage for separating off the fines 0 . . . 2 mm, that the screen oversize of the second stage, if appropriate after removal of metallic materials and inert materials, is mechanically comminuted, and the screen undersize of the second stage is fed to a special treatment, e.g. a melting furnace. In this melting process, carried out for example in an arc furnace, a vitreous readily landfilled product and a metal concentrate are produced (see F.-G. Simon and K.-H. Andersson: InRec-Verfahren—Verwertung von Reststoffen aus der thermischen Abfallbehandlung [InRec process—utilization of residues from thermal waste treatment], ABB Technik 9/1995, pp. 15–20). This reprocessing process has been used previously in practice for the slag from grate incineration furnaces and has proved to be useful there. Disadvantages are on the one hand the high costs which result from the use of the arc furnace, and on the other hand the many classification and comminution stages for the slag or ash.

Various volatilization processes are known from the metallurgical industry for metal production, for example the rolling process. This process which operates with reducing conditions has the purpose of producing heavy metals such as lead, zinc and cadmium, in the form of highly enriched fly dusts (see Ullmann: Enzyklopädie der technischen Chemie [Encyclopedia of Industrial Chemistry], 4th edition, p. 429). As starting material, use is made in the rolling process of lean, oxidic, non-readily-beneficiated zinc-lead ores, zinc-lead-containing fly dusts and foundry waste products. These metalliferous starting materials are mixed with a reducing agent, e.g. coke or anthracite, and fed to a rotary kiln. They travel through the furnace, being heated in the course of this, until the volatilization begins at about 1000° C. The volatilization reactions (reaction of the solid metal oxides with the admixed carbon to form gaseous metals and carbon monoxide) proceed in the solids layer of the rotary kiln, which solids layer is constantly recirculated. In the gas space which is above it and has an oxidizing atmosphere, the volatilization products are then reoxidized. These oxidation products from the gaseous phase are very finely particulate, so that they are entrained by the flue gas, transported out of the furnace and are finally separated off after the flue gases have cooled. The slag low in metals is discharged from the furnace, cooled and then placed on a slag heap.

SUMMARY OF THE INVENTION

Accordingly, one object of the invention, which attempts to avoid the abovementioned disadvantages in the known reprocessing of refuse slag, is to provide a novel, effective and inexpensive process for reprocessing slag and/or ash from the thermal treatment of refuse, which process may be implemented by a robust and simple technology and, using which, a pollutant-depleted inert slag may be produced without additional classification and comminution stages.

According to the invention, this is achieved in a process in which the refuse is pyrolyzed, gasified or partially combusted in a first process step, heavy-metal-containing slag and/or ash having a comparatively high carbon content being formed, said slag and/or ash being heated in a rotary kiln to a temperature below the melting temperature of the slag and/or ash in a second process step, the slag and/or ash, prior to its discharge from the rotary kiln, dwelling sufficiently long in the rotary kiln, that the heavy metals present therein are converted into their metallic form by reduction at the carbon endogenous to the slag and the readily volatile heavy metals such as zinc, lead arsenic and cadmium are transferred to the gas phase and are discharged from the rotary kiln together with the flue gas, and a slag depleted in heavy metals being discharged from the rotary kiln.

The advantages of the invention are that the slag is produced in a pollutant-depleted state. The heavy metal contents are markedly below the legally prescribed maximum values for landfills for inert substances in the Swiss Technical Regulation on Waste of Dec. 10, 1990. Highly dangerous hydrocarbon compounds, such as dioxins, are below the limit of detection. Therefore, the slag reprocessed in this manner can, after simple separation of ferrous and nonferrous metals, be used, for example, as building material in road construction or in other ways. Expensive deposition in landfill is not required. Furthermore, reprocessing in a rotary kiln represents advantageous utilization of a robust technology. Time-consuming classification and comminution stages for reprocessing the slag are not necessary.

It is advantageous if filter dust produced in the pyrolysis, gasification or partial combustion and removed in a dedusting plant is admixed to the slag and/or ash and both together are heated in the rotary kiln and depleted in heavy metals. Thus, even the fly dust from the dust separator can be freed simply from heavy metal contaminants.

Furthermore, it is expedient if both the gasification or partial combustion of the refuse and the volatilization of the heavy metals from the slag/ash formed in the combustion take place in a single unit, i.e. in the rotary kiln, the combustion air rate being such that virtually no oxygen can be detected any longer at the end of the rotary kiln. This can give cost savings. However, then, only a portion of the filter dust can be recirculated to the rotary kiln, since otherwise the volatile heavy metals concentrate in the flue gas.

It is advantageous if the residence time of the slag and/or ash in the rotary kiln is more than one hour, because the volatilization reactions then have sufficient time available.

Furthermore, it is advantageous if the flue gases from the rotary kiln are cooled and dedusted in a filter and in this manner the air pollution is kept low.

It is expedient if the slag and/or ash is discharged dry from the pyrolysis, gasification or combustion furnace without water moistening and ferrous and nonferrous metals are separated off prior to its being charged into the rotary kiln. Furthermore, it is advantageous if the residual metallic constituents are removed from the slag discharged from the rotary kiln by means of magnetic separators and nonferrous metal separators.

Furthermore, it is advantageous if the slag and/or ash introduced into the rotary kiln comprises at least 10% carbon, because a sufficiently large amount of reducing agent is then available for the reduction and volatilization of the heavy metals.

Finally, it is advantageous if the slag is discharged dry from the rotary kiln and separated into at least two fractions, the first fraction having a particle size greater than approximately 32 mm being separated off in a first screening stage as screen oversize, and the screen undersize being fed to a second classification stage to separate off the fines content 0 . . . 2 mm, at least a portion of the fines content 0 . . . 2 mm being recirculated from the slag reprocessing into the rotary kiln on the air inlet side and burned there. This increases the degree of combustion of the ash in the rotary kiln and further decreases the pollutant content of the slag.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

Only elements essential to the understanding of the invention are shown. Those which are not shown are, for example, the furnace charging device and ferrous and nonferrous metal separators. The direction of flow of the media is indicated by arrows.

DESCRIPTION OF THE PREFERRED EMBODIMENTS

Figure 1:
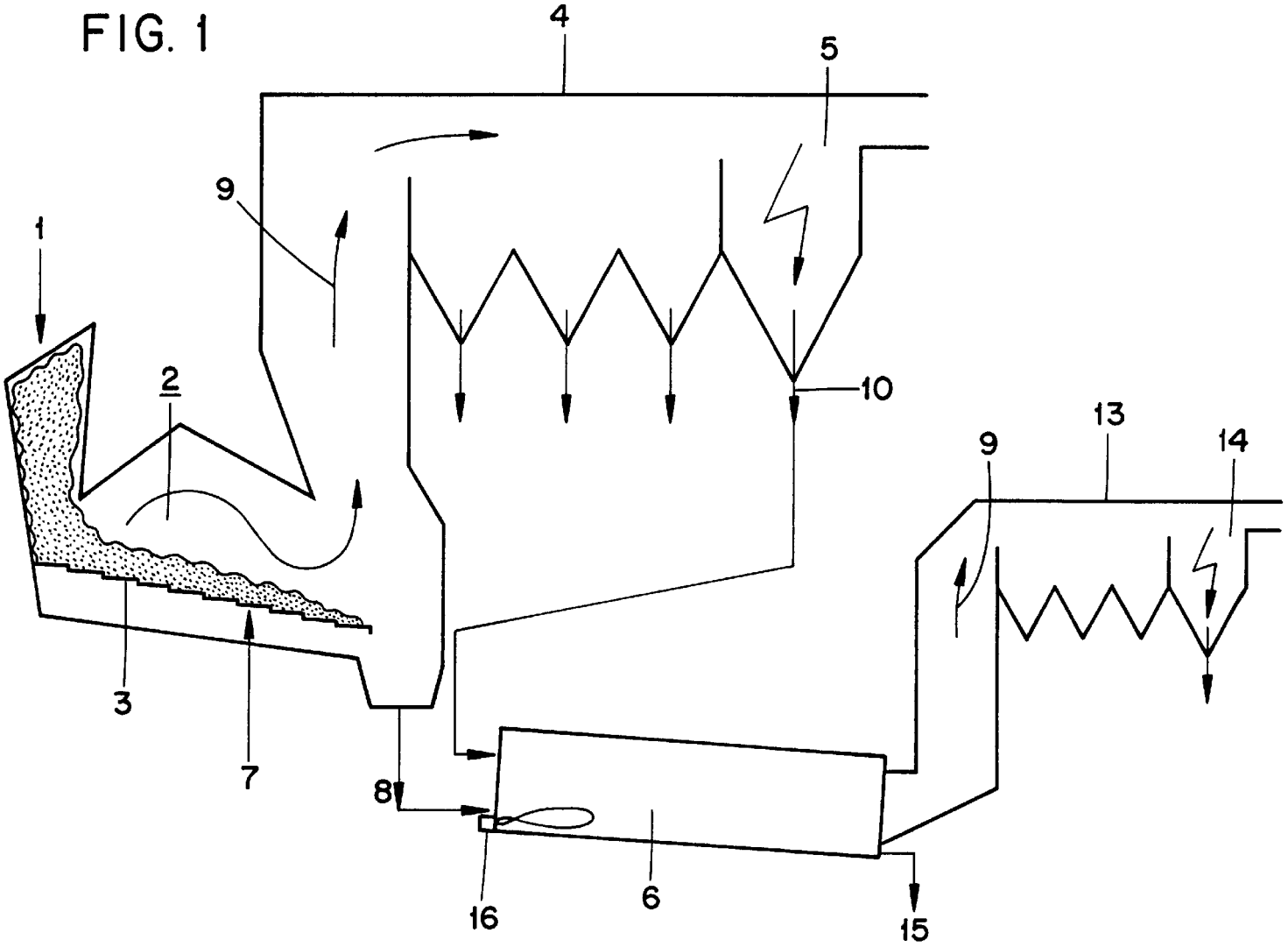
FIG. 1 shows a diagrammatic representation of the process according to the invention in a first exemplary embodiment, in which the refuse is partially burned on a combustion grate and the slag and ash are then fed from the refuse incineration to a rotary kiln and reprocessed there.

Referring now to the drawings, wherein like reference numerals designate identical or corresponding parts throughout the several views, in FIG. 1 a diagrammatic representation is given of the process according to the invention in a first exemplary embodiment. Refuse 1, preferably domestic refuse, is fed, via a charging device which is not shown, to a refuse incineration furnace 2 and is there burned on a grate 3 by a grate-firing process. Downstream of the incineration furnace 2 are connected, on the gas side, a boiler 4 and a dedusting unit 5, e.g. an electrostatic precipitator. On the slag side, a rotary kiln 6 is connected downstream of the incineration furnace 2.

The refuse 1 is burned in the combustion furnace 2 with feed of primary air 7 in such a manner that a slag 8 is produced which has a loss on ignition of at least 10%. The loss on ignition is a measure of the unburned portion in the slag 8 and thus an indirect measure of the carbon content. In order that this relatively high loss on ignition and thus high carbon content is achieved, incomplete combustion must occur in furnace 2. Previously, a combustion by grate-firing processes has always had the purpose of, as far as possible, burning the refuse 1 completely, i.e. of producing a slag having a loss on ignition as low as possible and thus low carbon content. In addition to the slag 8, the combustion of the refuse 1 also produces fly dust-laden flue gases 9 which pass via the boiler 4 into the dedusting unit 5. There, the fly dusts are separated off from the flue gas 9 and discharged as filter dust 10 (=fly ash).

The heavy-metal- and carbon-containing slag 8 from the incineration furnace 2 falls, without intermediate cooling, directly from the grate 3 into the rotary kiln 6. It is discharged dry without water moistening. The slag 8 has a temperature of approximately 400° C. downstream of the grate. In the rotary kiln, it is, together with the filter dust 10 from the dedusting unit 5 heated by an oil burner 16 to a temperature of 900° C. This temperature is below the melting temperature of the slag/ash 8, 10, but above the volatilization temperature of the heavy metals present therein. In the present exemplary embodiment, a slag rate of 2500 kg/h and a fly ash rate of 200 kg/h were used. The rotary kiln 6 is of a size sufficient that the residence time of the slag/ash 8, 10 in the rotary kiln 6 downstream of the heating is approximately 1.5 hours. For this reason, the rotary kiln has a length of 8 m and an inner diameter of 2.5 m.

The volatilization reactions (reaction of the heavy metal oxides with the carbon present in the slag to form gaseous metals and carbon monoxide) proceed in the solids layer of the rotary kiln 6, which layer is constantly recirculated. In the gas space which is above it and has an oxidizing atmosphere, the volatilization products are then reoxidized. These reaction products from the gaseous phase are very finely particulate, so that they are entrained by the flue gas 9. The flue gas 9 is then cooled in a steam boiler 13 and filtered in a dust filter 14. These heavy-metal-enriched filter dusts can then be further treated with the purpose of recovering the heavy metals present therein. The heavy-metal-depleted slag 15 is discharged from the rotary kiln 6, cooled and, after removal of scrap and separation off of nonferrous metals by a magnetic separator and nonferrous metal separator (not shown in FIG. 1), can be reused without problem (e.g. as building material in road construction) or placed on a slag heap.

The table below shows, for the above-described exemplary embodiment, the heavy metal and dioxin contents for the starting materials and the end product of the rotary kiln 6 in comparison with the maximum values for inert matter landfilling quality in accordance with the Swiss regulations:

| | | Fly ash | Slag from grate | Slag downstream of rotary kiln | Swiss Technical Regulation Inert matter landfilling quality |
|---|---|---|---|---|---|
| Loss on ignition | % | 5 | >10.0 | <1 | |
| Pb | ppm | 9000 | 2500.0 | 400 | 500 |
| Zn | ppm | 16,000 | 4000.0 | 500 | 1000 |
| Cd | ppm | 2400 | 13.0 | n.d. | 10 |
| Dioxin concentration | ng TE/kg | 1600 | 11.5 | n.d. | |

As can be seen from the table, the heavy metal contents are significantly below the legally prescribed maximum values for inert matter landfills of the Swiss Technical Regulation on Waste. The highly dangerous hydrocarbon compounds, such as dioxins, are even below the limit of detection.

Figure 2:
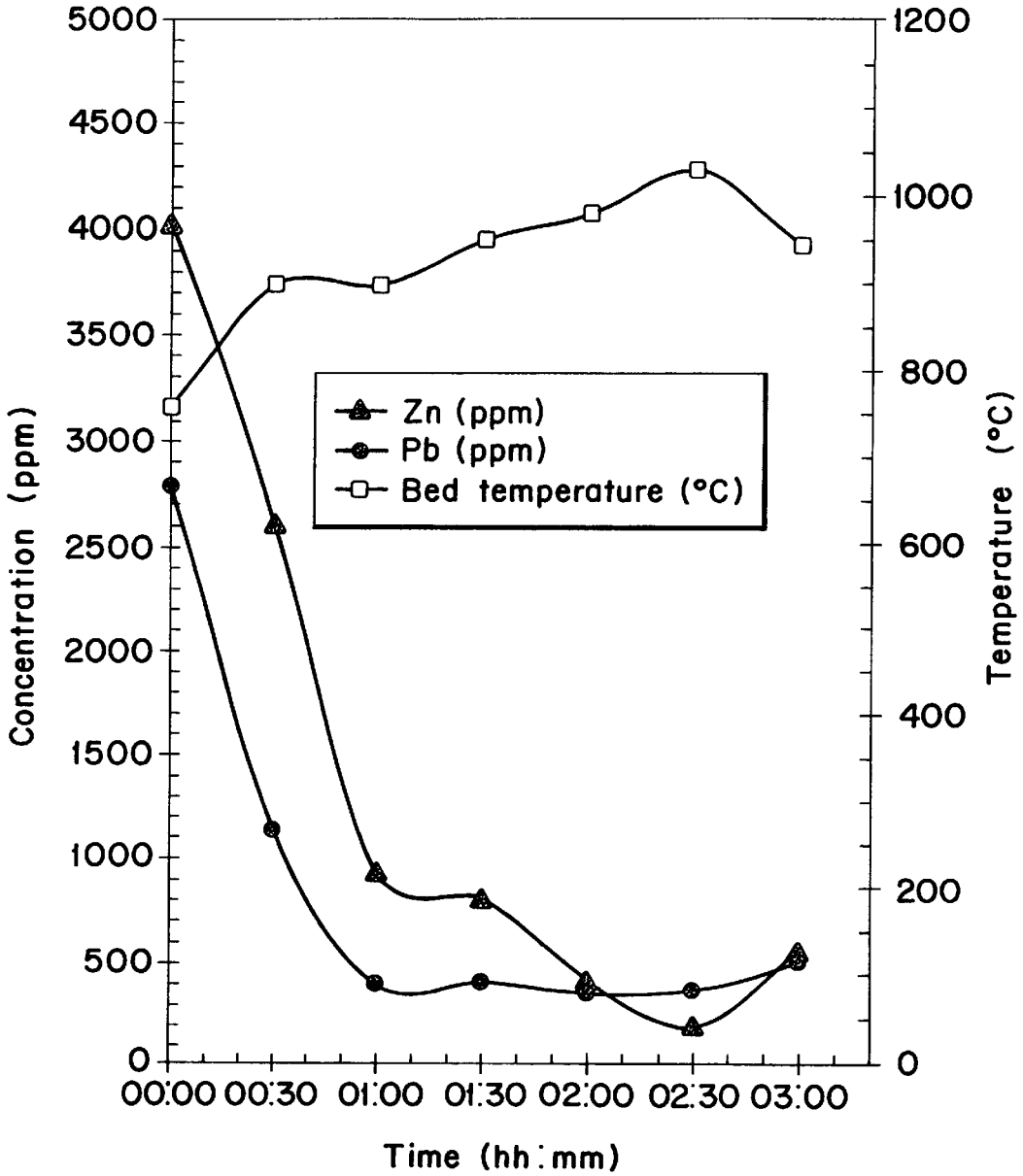
FIG. 2 shows a diagram which on the one hand shows the zinc and lead concentrations in the slag as a function of their residence time in the rotary kiln and on the other hand shows the bed temperatures as a function of time.

FIG. 2, to clarify the above-described, further shows a diagram which on the one hand shows the zinc and lead concentrations in the slag as a function of their residence time in the rotary kiln and on the other hand shows the bed temperatures as a function of this time. The course of the curves shows that the slag 8 should dwell for at least one hour in the rotary kiln 6, because sufficiently great depletion in heavy metals does not occur until then.

The slag reprocessed in this way can be used, for example, as building material in road construction or in other ways. Expensive deposition in landfills is not needed. Furthermore, reprocessing in a rotary kiln represents the advantageous utilization of a robust technology. Time-consuming classification and comminution stages for reprocessing the slag are not necessary.

Obviously, the process can also be successfully employed without the use of filter dust 10, by feeding only the carbon-containing slag 8 from the grate combustion to the rotary kiln 6.

Figure 3:
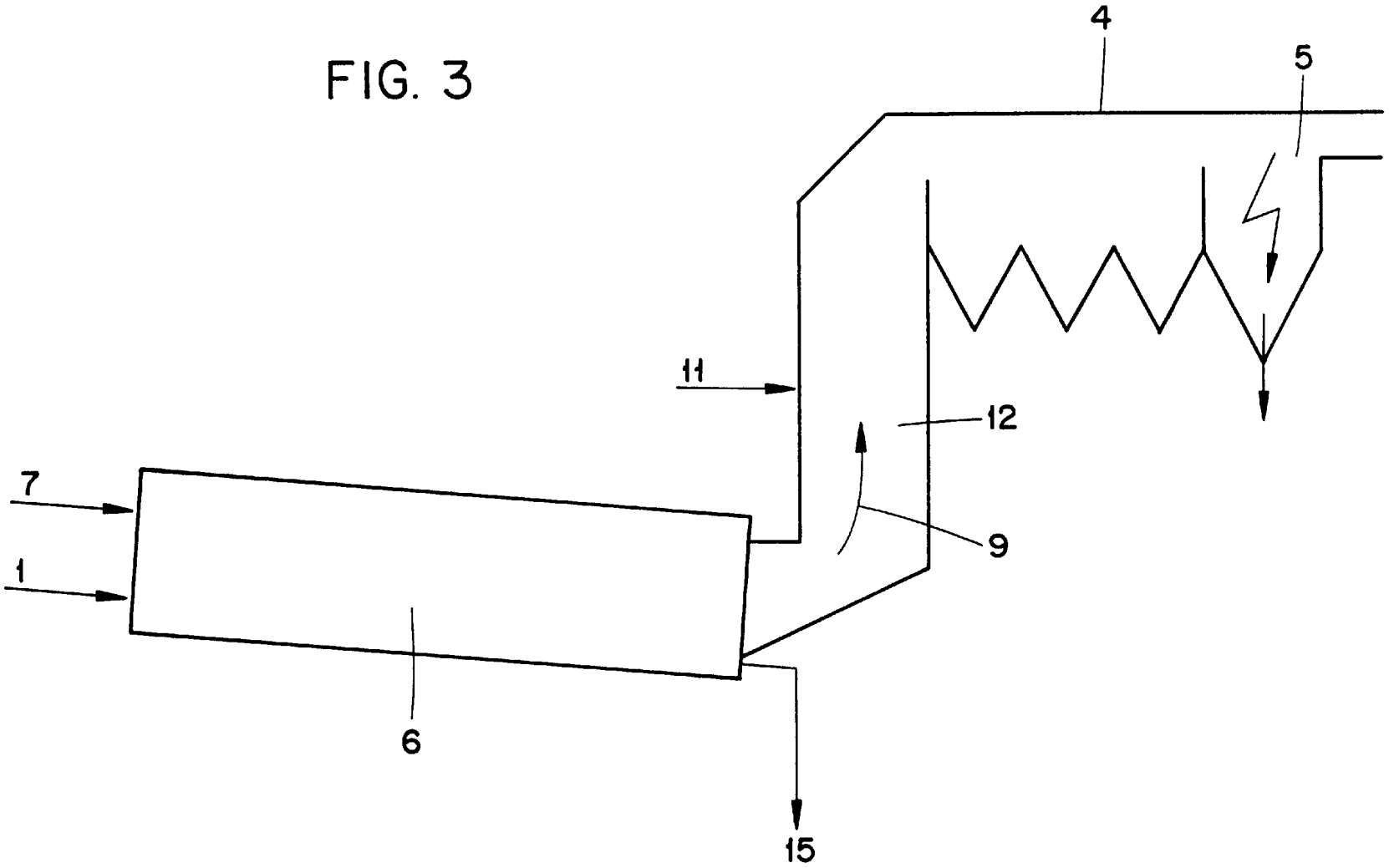
FIG. 3 shows a diagrammatic representation of the process according to the invention in a second exemplary embodiment, in which the refuse is combusted and the slag reprocessed in one and the same rotary kiln.

FIG. 3 shows a further exemplary embodiment. Here, the refuse incineration and the slag reprocessing take place in one and the same unit. Untreated domestic refuse 1 having a heating value of approximately 10,000 kJ/kg is introduced into a rotary kiln 6 having a length of 12 m and a rotary kiln inner diameter of 4 m. The refuse rate is 10,000 kg/h. The refuse 1 is then partially burned by addition of air, the combustion air 7 having been preheated to a temperature of approximately 400° C. The combustion air 7 rate is such that, on the one hand, a temperature of 1000° C. is not exceeded anywhere in the furnace 6, so that the resulting ash is not melted and that, on the other hand, virtually no oxygen can be detected in the flue gas 9 at the end of the rotary kiln 6. In the present example, the combustion air 7 rate is 12,000 $m^3$ (STP)/h. The residence time of the refuse 1 in the rotary kiln 6 is approximately 2 hours. This time is sufficient, on the one hand, to burn the refuse 1 (incompletely) and, on the other hand, to deplete the slag/ash of heavy metals resulting in the course of this by volatilizing them. The slag 15 is thereafter discharged from the rotary kiln 6, cooled and can, as already described in the first exemplary embodiment, be further used after separating off ferrous and nonferrous metal. The heavy metal contents and dioxin concentration below are still present in the slag 15 after carrying out the process according to the invention:

| | | Slag downstream of rotary kiln |
|---|---|---|
| Loss on ignition | % | <1 |
| Pb | ppm | 300 |
| Zn | ppm | 400 |
| Cd | ppm | n.d. |
| Dioxin concentration | ng TE/kg | n.d. |

Flue gas 9 from the rotary kiln 6 is then completely burned in the afterburning chamber 12 by addition of secondary air 11, cooled in boiler 4 (flue gas rate at the end of the boiler approximately 53,600 $m^3$ (STP)/h) and cleaned up in a flue gas emission control unit 5.

Obviously, the invention is not restricted to the exemplary embodiments shown. Thus, for example, domestic refuse or municipal refuse 1 can, instead of a partial combustion in the first process step, also be subjected to a pyrolysis or gasification. It is of importance only that at least 10% carbon is present in the slag/ash 8, in order that in the second process step the conditions are satisfied for a successful reduction and volatilization of the heavy metals in the rotary kiln 6. Furthermore, it is advantageous if ferrous metals and nonferrous metals, which can be utilized in other ways, are separated off from the slag/ash 8 before it is charged into the rotary kiln 6. Finally, it is also expedient if the slag 15 is discharged dry from the rotary kiln 6 and separated into at least two fractions, the first fraction having a particle size of greater than approximately 32 mm being separated off as screen oversize in a first screening stage and the screen undersize being fed to a second classification stage for separating off the fines content 0 . . . 2 mm, and at least a portion of the fines content 0 . . . 2 mm from the slag reprocessing being recirculated to the rotary kiln 6 on the air inlet side and burned there. As a result, the degree of combustion of the ash in the rotary kiln 6 is increased and the pollutant content of the slag is further reduced.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A process for reprocessing slag and/or ash from the thermal treatment of refuse, comprising: receiving refuse that has been pyrolyzed, gasified or partially combusted to form a heavy-metal-containing slag and/or ash having a comparatively high carbon content, heating the slag and/or ash in a rotary kiln to a temperature below the melting temperature of the slag and/or ash, retaining the slag and/or ash in the rotary kiln for a sufficiently long time that the heavy metals present therein are converted into their metallic form by reduction at the carbon endigenous to the slag and the readily volatile heavy metals are transferred to the gas phase and are discharged from the rotary kiln together with the flue gas, and discharging the slag depleted in heavy metals from the rotary kiln.

2. The process as claimed in claim 1, wherein both the gasification or partial combustion of the refuse and the reduction and volatilization of the heavy metals from the slag/ash formed in the combustion take place in a single unit, the combustion air rate being such that virtually no oxygen can any longer be detected at the end of the rotary kiln.

3. The process as claimed in claim 1, wherein filter dust formed in the course of the pyrolysis, gasification or partial combustion and separated off in a dedusting unit is admixed to the slag and/or ash and these are heated together in the rotary kiln and depleted in heavy metals.

4. The process as claimed in claim 1, wherein the residence time of the slag and/or ash in the rotary kiln is more than one hour.

5. The process as claimed in claim 1, wherein the flue gases from the rotary kiln are cooled and dedusted in a filter.

6. The process as claimed in claim 1, wherein the slag and/or ash is discharged dry from the pyrolysis furnace or combustion furnace without water moistening.

7. The process as claimed in claim 1, wherein the residual metallic constituents are removed from the slag discharged from the rotary kiln by means of magnetic separators and nonferrous metal separators.

8. The process as claimed in claim 1, wherein the slag and/or ash introduced into the rotary kiln comprises at least 10% carbon.

9. The process as claimed in claim 1, wherein ferrous and nonferrous metals are separated off from the slag and/or ash before it is charged into the rotary kiln.

10. The process as claimed in claim 1, wherein the slag is discharged dry from the rotary kiln and separated into at least two fractions, the first fraction having a particle size greater than approximately 32 mm being separated off in a first screening stage as screen oversize, and the screen undersize being fed to a second classification stage to separate off the fines content 0 . . . 2 mm, at least a portion of the fines content 0 . . . 2 mm from the slag reprocessing being recirculated into the rotary kiln on the air inlet side and burned there.

11. The process as claimed in claim 1, wherein the slag and/or ash has a temperature of approximately 400° C. in the receiving step.

12. The process as claimed in claim 1, wherein the slag and/or ash is heated in the rotary kiln to a temperature of approximately 900° C. during the heating step.

13. The process as claimed in claim 1, wherein the temperature of the slag and/or ash in the rotary kiln does not exceed 1000° C.

* * * * *